United States Patent [19]

Durrum et al.

[11] Patent Number: 5,033,943

[45] Date of Patent: Jul. 23, 1991

[54] LOW FLUID SHEAR PUMP

[75] Inventors: Emmett L. Durrum, Menlo Park; Leonard L. Manning, Oakdale, both of Calif.

[73] Assignee: Eldex Laboratories, Inc., San Carlos, Calif.

[21] Appl. No.: 462,041

[22] Filed: Jan. 8, 1990

[51] Int. Cl.[5] ..... F04B 43/08

[52] U.S. Cl. ..... 417/478; 417/475

[58] Field of Search ..... 417/474–478; 604/153

[56] References Cited

U.S. PATENT DOCUMENTS

| | | | |
|---|---|---|---|
| 2,412,397 | 12/1946 | Harper . | |
| 2,963,014 | 12/1960 | Voelcker . | |
| 3,046,903 | 7/1962 | Jones | 417/475 X |
| 3,127,845 | 4/1964 | Voelcker . | |
| 3,349,716 | 10/1967 | Weber | 417/478 |
| 4,012,177 | 3/1977 | Yakich | 417/478 X |
| 4,182,465 | 1/1980 | Bennett . | |
| 4,222,501 | 9/1980 | Hammett et al. . | |
| 4,365,943 | 12/1982 | Durrum . | |
| 4,373,867 | 2/1983 | Campbell | 417/478 X |
| 4,549,860 | 10/1985 | Yakich | 417/477 X |
| 4,722,372 | 2/1988 | Hoffman et al. | 417/478 X |
| 4,781,548 | 11/1988 | Alderson et al. | 417/478 X |
| 4,936,760 | 6/1990 | Williams | 417/478 X |

FOREIGN PATENT DOCUMENTS

| | | | |
|---|---|---|---|
| 52-001603 | 1/1977 | Japan | 417/475 |

OTHER PUBLICATIONS

Albo, IBM Technical Disclosure Bulletin, Positive Displacement Pump, Apr. 1965, vol. 7, No. 11.

Steripump, a Steridose Publication.

*Primary Examiner*—Leonard E. Smith

*Assistant Examiner*—Eugene L. Szczecina, Jr.

*Attorney, Agent, or Firm*—Flehr, Hohbach, Test, Albritton & Herbert

[57] ABSTRACT

A pump (20) has a housing (22) consisting of top (24), bottom (26), sides (28) and (30) and ends (32), (34), and (36) defining a plenum (38). An axially extending passage (40) is formed by the ends (32) and (34), through which flexible tubing (42) passes. The plenum (38) is connected to the passage (40). A pressure block (44) is slideably positioned in the plenum (38) for movement toward and away from the flexible tubing (42). The pressure block (44) has a rectangular opening (46), which receives a circular bearing (48) and a circular cam (50) which is eccentrically mounted on shaft (52). Conventional ball valves (54) and (56) are provided in the flexible tubing (42) above and below the pressure block (44). The lifetime of the tubing is substantially enhanced if the pressure block (24) depresses the tubing (42) no more than half of its inside diameter. When this limitation is followed, no creasing or similar localized severe distortion of the tubing (42) takes place. Rounded corners (58) and rounded surface (59) of the pressure block (24) extending a substantial length along the tubing (42) further help to avoid creasing or other severe distortion of the tubing (42).

5 Claims, 8 Drawing Sheets

LOW FLUID SHEAR PUMP

BACKGROUND OF THE INVENTION

1. Field of the Invention

The present invention relates generally to a pump which will provide moving force for fluid flow of liquids without subjecting the liquids to substantial mechanical shear stresses. More particularly, it relates to such a pump which is especially suited for pumping liquids used in biochemical procedures, such as fragile proteins and/or cell suspensions, and other liquids subject to damage if subjected to substantial mechanical shear stresses in fluid flow.

2. Description of the Prior Art

It is known in the art to utilize a tube which is deformed by a roller or a plunger for the purpose of pumping liquids. Such pumps are disclosed, for example, in the following issued U.S. Pat. Nos.: 2,412,397, issued Dec. 10, 1946 to Harper; 2,963,014, issued Dec. 6, 1960 to Voelcker; 3,127,845, issued Apr. 7, 1964 to Voelcker; 4,182,465, issued Jan. 8, 1980 to Bennett; 4,222,501, issued Sept. 16, 1980 to Hammett et al. and commonly assigned 4,365,943, issued Dec. 28, 1982 to Durrum. Another form of pump intended for liquids subject to damage by mechanical shear is a pneumatically actuated membrane/hose pump, commercially available under the designation Steripump, from Steridose Systems AB, Gothenburg, Sweden.

While pumps of the type disclosed in these issued patents and the above commercial product have proved to be satisfactory for their intended applications, there is a continuing demand for pumps that will meet the stringent requirements of biochemical reagent and reaction product liquids. These liquids typically are pharmaceutical solutions having a high value per unit volume. Loss of these liquids by leakage would therefore be costly. Pumps and other equipment used to handle them must therefore be very reliable. A significant problem with prior art pumps utilizing distortion of a flexible tube to pump the liquids is the short lifetime of the tube as a result of creasing it. Prior art flexible tube designs as disclosed in the above patents result in creasing the tube or similar severe localized distortion as the tube is flexed to provide the pumping action. Such creasing or other severe localized distortion of the tube causes it to fail and leak after a short time. The biochemical liquids also contain very fragile long chain protein molecules or fragile cells in suspension and cannot be subjected to substantial mechanical shear stress during their fluid flow without being damaged. A need therefore remains for a pump that will meet the demands of these and other liquids that are subject to damage when subjected to mechanical shear stress.

SUMMARY OF THE INVENTION

Accordingly, it is an object of this invention to provide a pump which is highly reliable in operation and which will pump liquids without subjecting them to substantial mechanical shear stresses.

It is another object of the invention to provide a pump utilizing deflection of a flexible tube which deflects the tube in a manner that allows the tube to have an increased length of use without leaking.

It is still another object of the invention to provide such a pump which will operate without creasing the tube or subjecting it to other localized severe distortion that will cause it to leak within a short time.

It is a further object of the invention to provide such a pump which will pump fragile biochemical liquids without damaging them and without leakage.

The attainment of these and related objects may be achieved through use of the novel low fluid shear pump herein disclosed. A low fluid shear pump in accordance with this invention has a housing with a passage extending through the housing and closely conforming in configuration to an external configuration of a flexible tube in the passage. While such a closely conforming configuration is desirably achieved with a friction fit between the tube and the passage, such a closely conforming configuration could also be achieved by expansion of a tube that has a somewhat smaller external diameter than a diameter of the passage. An essential aspect of this relationship is that the flexible tube be supported around its outside surface by the passage. An opening in the housing along a side of the passage extends along a substantial length of the flexible tube in the passage. A pressure block is reciprocally moveable through the opening into and out of engagement with the flexible tube to depress the flexible tube in the passage. The pressure block has a surface facing the flexible tube which extends along a substantial length of the flexible tube. A means reciprocally moves the pressure block into and out of engagement with the flexible tube to depress the flexible tube in the passage. Inlet and outlet check valves are connected to the flexible tube below and above the surface of the pressure block. In addition to providing a more effective pumping action with a given amount of deflection by the pressure block, thus avoiding use of enough deflection to crease the flexible tube, having the flexible tube closely conforming in configuration to the passage and being supported by the passage augments the restoring force of the tube when it is not being deflected by the pressure block.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
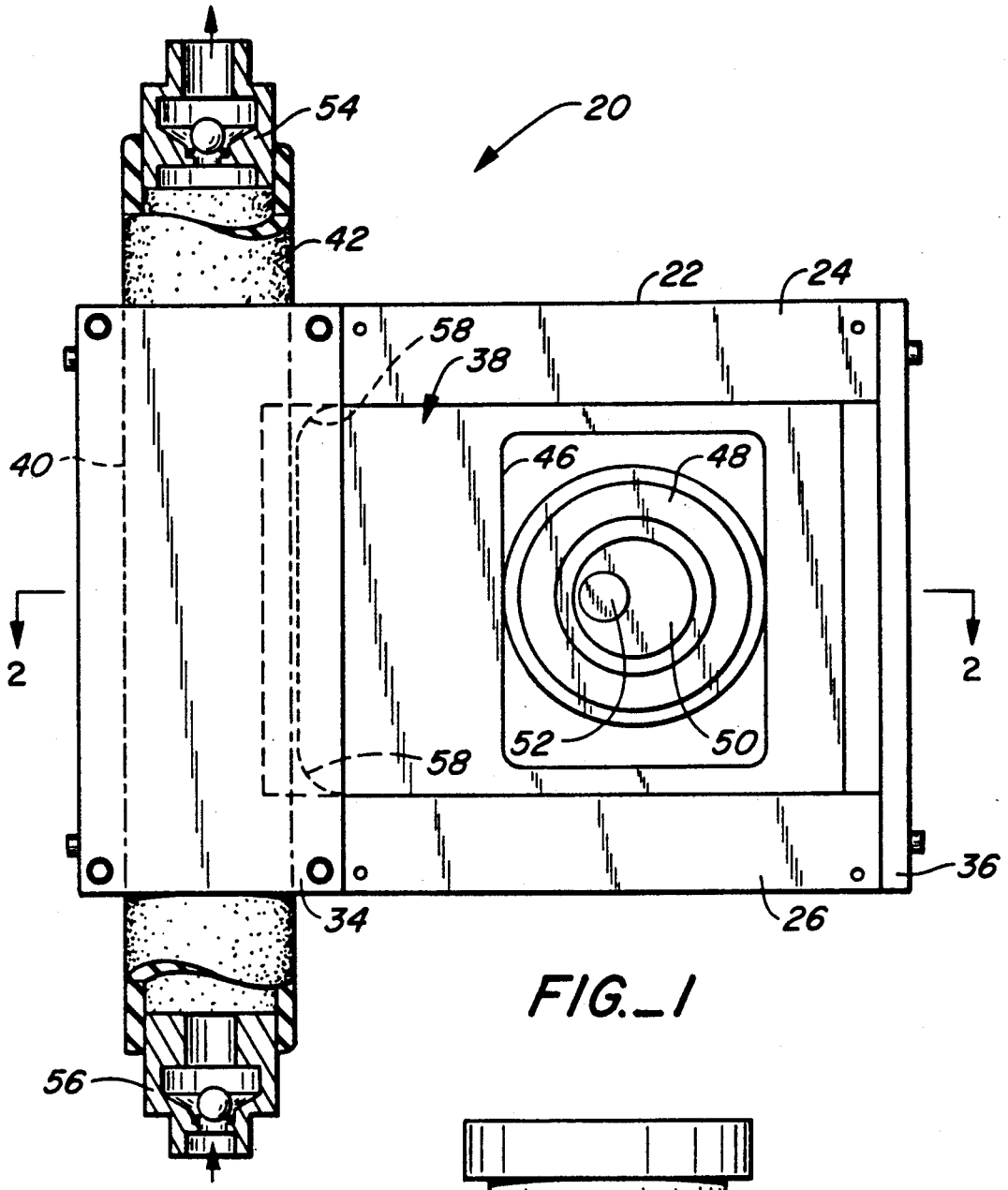
FIG. 1 is a front elevation view of a pump in accordance with the invention, with its side off to show interior detail.
Figure 2:
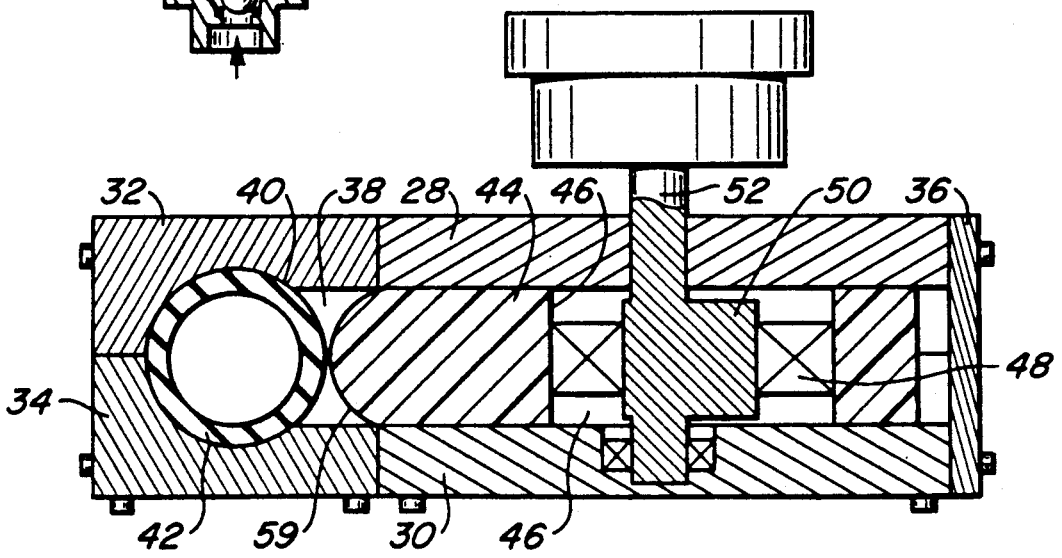
FIG. 2 is a top section view, taken along the line 2—2 in FIG. 1, but with the side in place.
Figure 3:
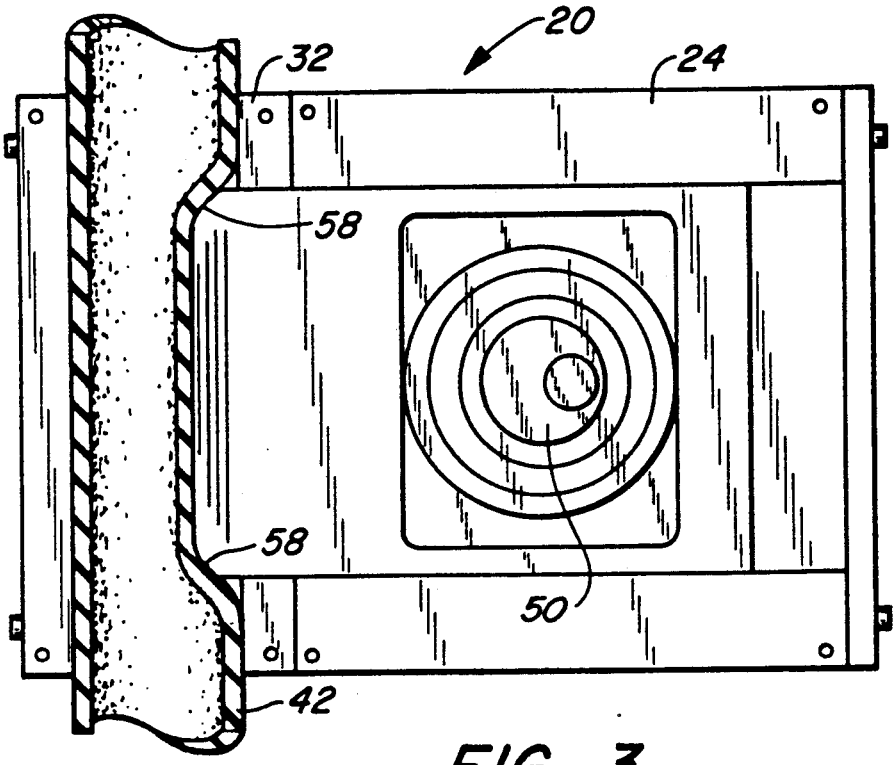
FIG. 3 is another front elevation view of the pump in FIGS. 1-2, with a partial section, but in another position during operation.

Turning now to the drawings, more particularly to FIGS. 1-3, there is shown a pump 20 having a housing 22. The housing 22 consists of top 24, bottom 26, sides 28 and 30 and ends 32, 34, and 36 defining a plenum 38. An axially extending passage 40 is formed by the ends 32 and 34, through which flexible tubing 42 passes. The plenum 38 is connected to the passage 40. A pressure block 44 is slideably positioned in the plenum 38 for movement toward and away from the flexible tubing 42. The pressure block 44 has a rectangular opening 46, which receives a circular bearing 48 and a circular cam 50 which is eccentrically mounted on shaft 52. Conventional ball valves 54 and 56 are provided in the flexible tubing 42 above and below the pressure block 44. As shown, the valves 54 and 56 or other conventional valves performing an equivalent function are preferably supported in the housing 22. When this is done and the outside of the flexible tubing closely conforms to the passage 40, such as in a friction fit, the pump 20 is capable of handling liquids at a pressure of up to about 400 p.s.i.

In operation of the pump 20, the pump is ready for a pumping cycle when the pump is in the position shown in FIGS. 1 and 2. As the cam 50 rotates to the position shown in FIG. 3, the pressure block 24 moves to the left to engage the flexible tubing 42. As the tubing 42 is depressed by the pressure block 24, inlet ball valve 56 is closed, outlet ball valve 54 is opened, and a quantity of liquid between the ball valves 54 and 56 corresponding to the volume displaced by depressing the tubing 42 is expelled from the pump 20. When the cam 50 rotates from the position shown in FIG. 3 back toward the position shown in FIG. 1, the outlet ball valve 54 closes, the inlet ball valve 56 opens, the tubing 42 returns to its undepressed configuration, and liquid flows into the tubing 42 through the inlet valve 56 to replace that expelled in the pumping stroke.

In practice, it has been found that the lifetime of the tubing is substantially enhanced if the pressure block 24 depresses the tubing 42 no more than half of its inside diameter. As can be seen in FIG. 3, when this limitation is followed, no creasing or similar localized severe distortion of the tubing 42 takes place. Rounded corners 58 (FIG. 1) and rounded surface 59 (FIG. 2) of the pressure block 24 further help to avoid creasing or other severe distortion of the tubing 42. The pump 20 is able to provide effective pumping action with a limited amount of depression of the tubing 42 because the ends 32 and 34 enclose and provide rigid support for the tubing 42 where it is depressed by the pressure block 24.

Figure 4:
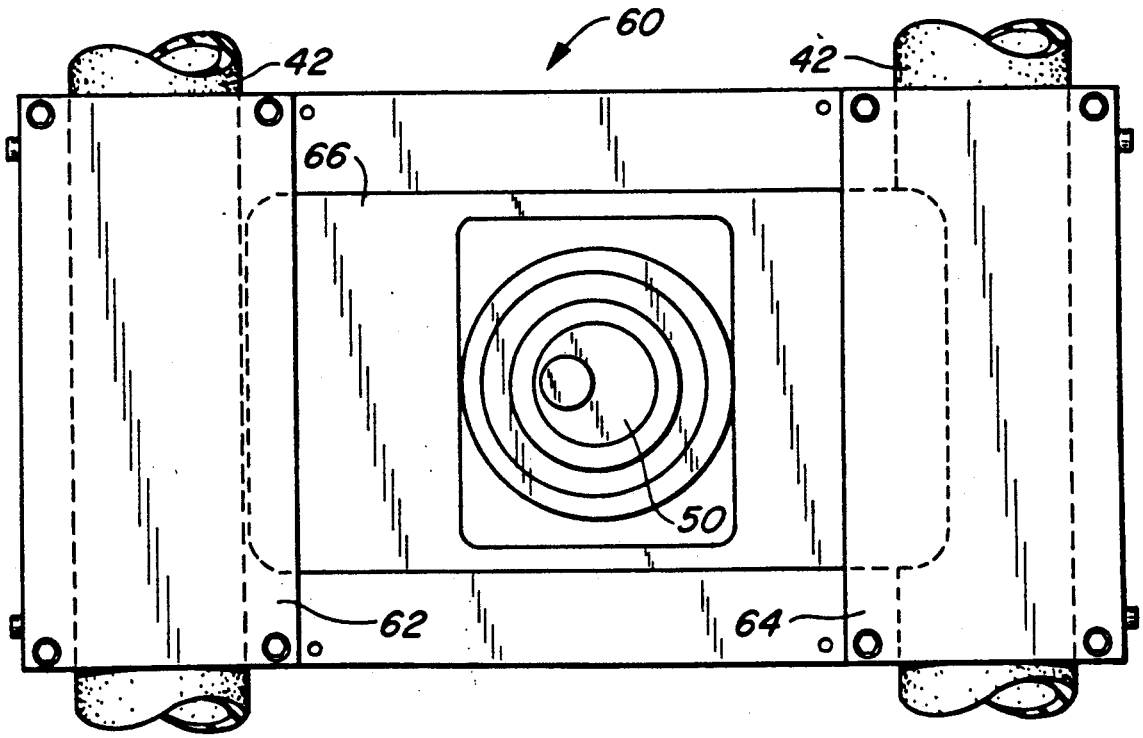
FIG. 4 is a front elevation view similar to that of FIG. 1 of a second embodiment of a pump in accordance with the invention.

FIG. 4 shows another pump 60 incorporating dual ends 62 and 64 and a pressure block 66 that engages tubing 42 at both ends 62 and 64 as the cam 50 rotates. Other than as shown and described, the construction and operation of the FIG. 4 embodiment of the invention is the same as that of the FIGS. 1-3 embodiment.

Figure 5:
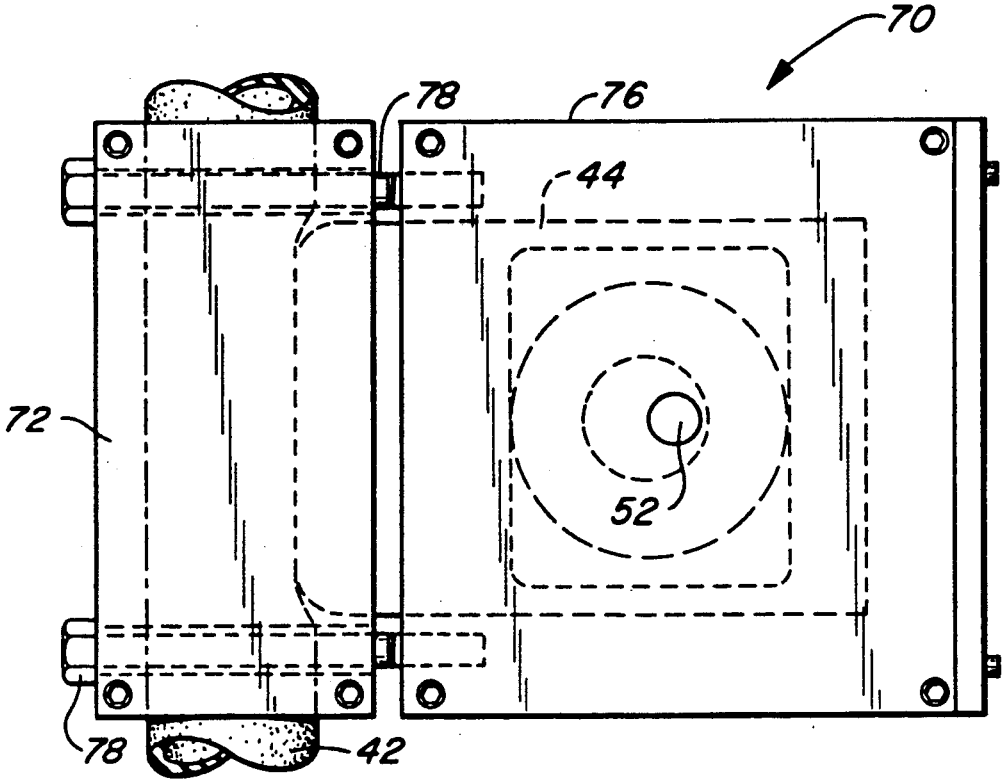
FIG. 5 is a front elevation view similar to that of FIGS. 1 and 4 of a third embodiment of a pump in accordance with the invention.

FIG. 5 shows a third pump 70 in which end 72 holding the tubing 42 is attached to housing 76 by bolts 78. The bolts 78 are threaded into the housing 76 a greater or lesser extent in order to adjust the position of tubing 42 relative to the pressure block 44. This position adjustment varies the extent of depression of the tubing 42 as the pressure block 44 reciprocates. Such a position adjustment allows the flow rate of liquid from the pump 70 to be easily adjusted without using a variable speed motor to turn shaft 52. Other than as shown and described, the construction and operation of the FIG. 5 embodiment of the invention is the same as that of the FIGS. 1-3 embodiment.

Figure 6:
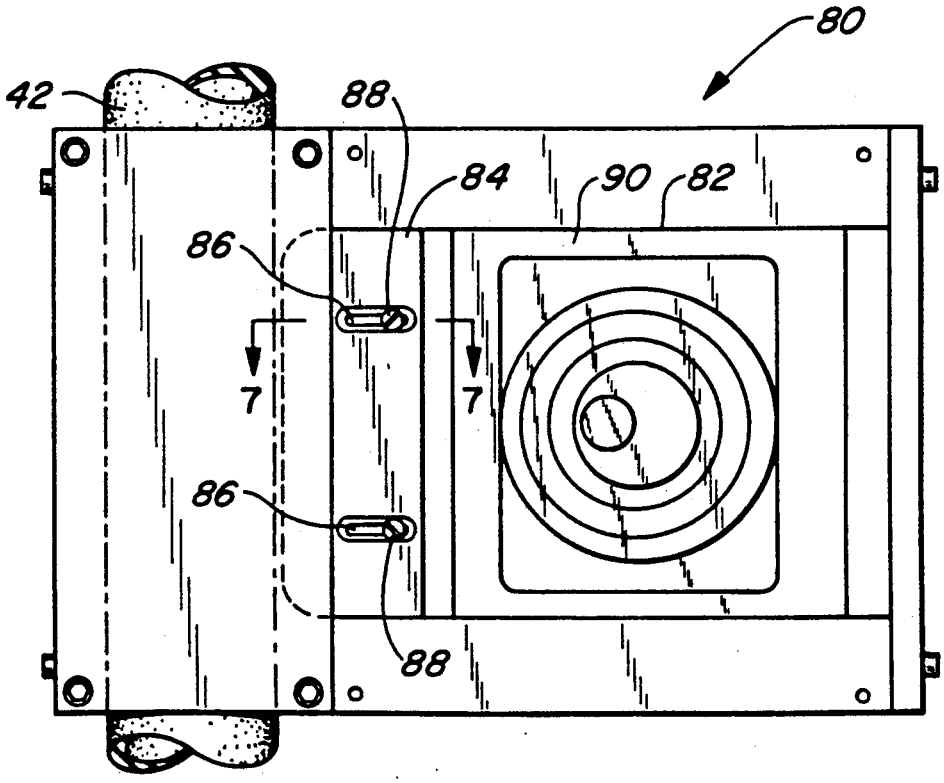
FIG. 6 is a front elevation view similar to that of FIGS. 1, 4 and 5 of a fourth embodiment of a pump in accordance with the invention.
Figure 7:
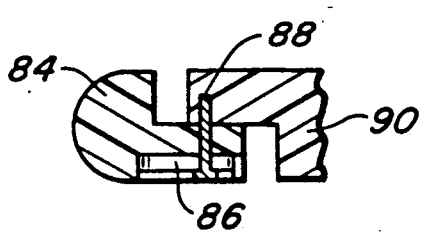
FIG. 7 is a partial section view, taken along the line 7—7 in FIG. 6.

In the fourth pump 80 of FIGS. 6 and 7, pressure block 82 has a front portion 84 having a pair of slots 86 through which machine screws 88 extend to fasten the front portion 84 to body portion 90 of the pressure block 82. By varying the position of the screws 88 in the slots 86, the length of the pressure block 82, and hence the proximity of the front portion 84 to the tubing 42 when the pressure block 82 is in its extreme right position as shown in FIG. 6, can be adjusted. The extent of depression of the tubing 42 during the pumping stroke is therefore changed in a manner similar to that of the FIG. 5 embodiment. Other than as shown and described, the construction and operation of the FIGS. 6 and 7 embodiment of the invention is the same as that of the FIGS. 1-3 embodiment.

Figure 8:
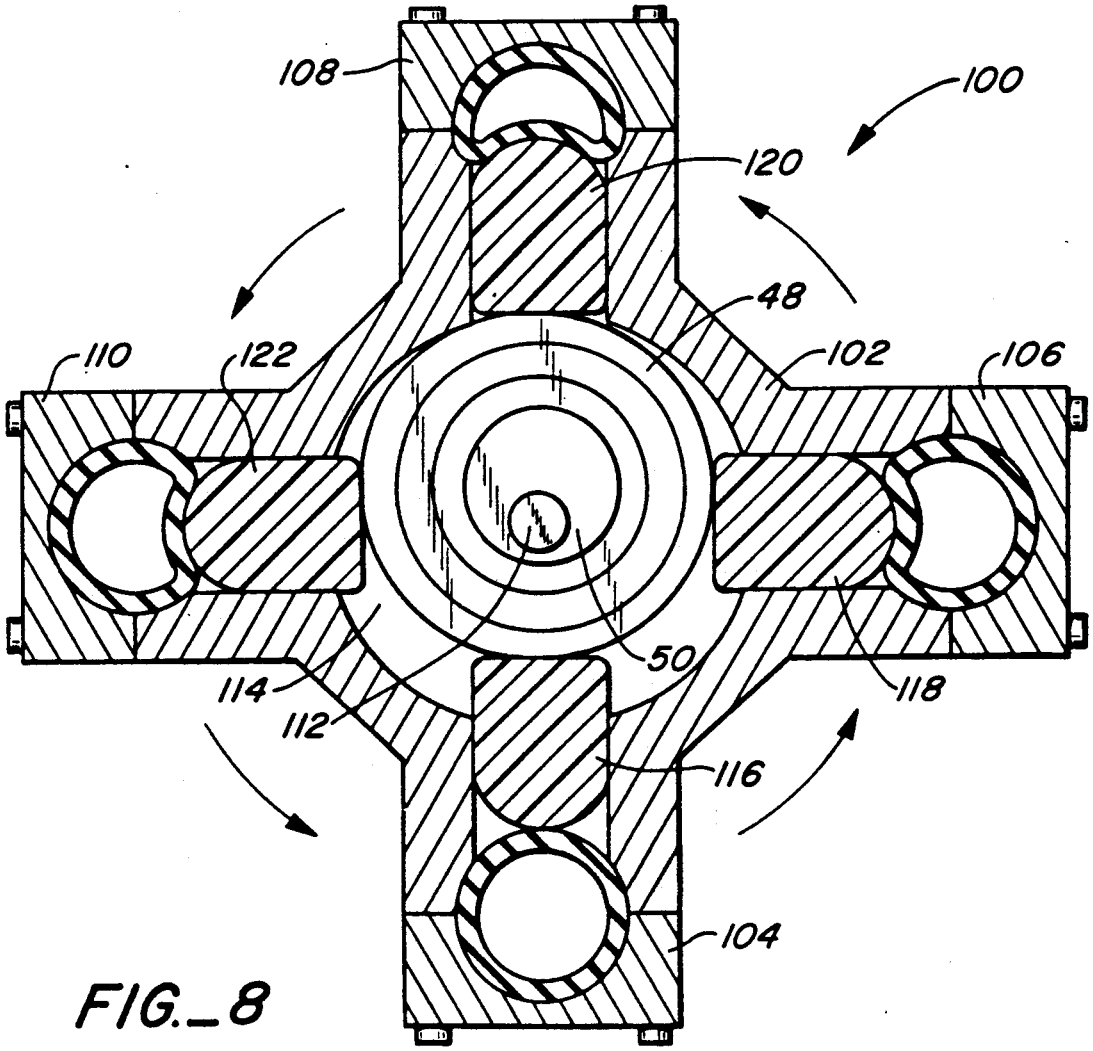
FIG. 8 is a top plan view in section of a fifth embodiment of a pump in accordance with the invention.

FIG. 8 shows a fifth pump 100 having a housing 102 with four radially displaced ends 104, 106, 108 and 110 spaced at 90° intervals attached to the housing 102. Cam 50 is eccentrically mounted for rotation on vertical shaft 112 within plenum 114. Pressure blocks 116, 118, 120 and 122 are sequentially urged against tubing 42 in the ends 104–110 as the cam 50 and bearing 48 rotate within the plenum 114. Other than as shown and described, the construction and operation of the FIG. 8 embodiment is the same as that of the FIGS. 1-3 embodiment.

Figure 9A:
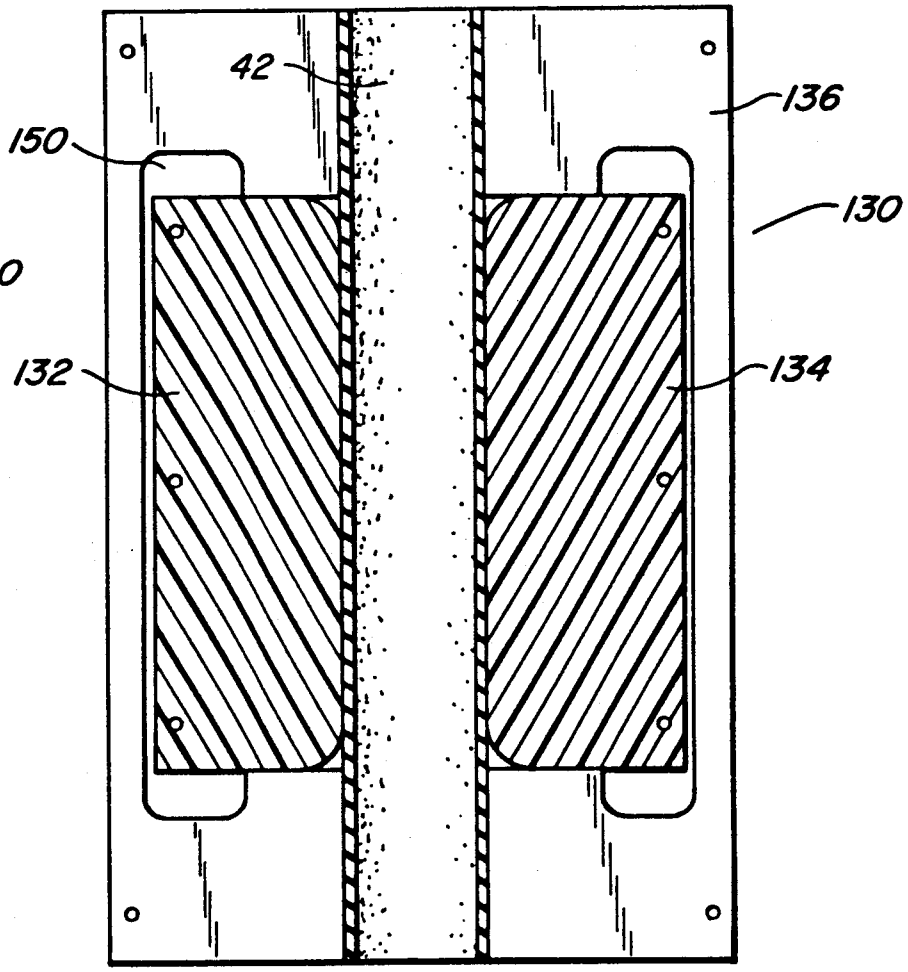
FIG. 9A is a similar top plan view in partial section to that shown in FIG. 9, but taken along the line 9A—9A in FIG. 10.
Figure 9:
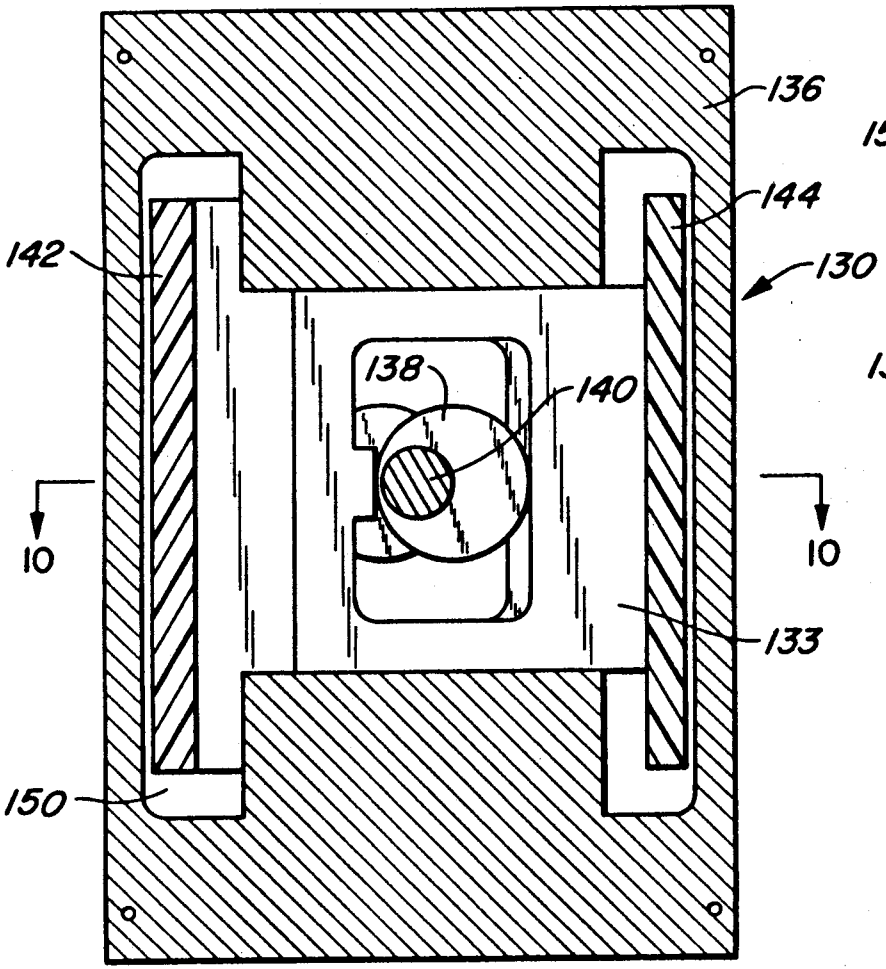
FIG. 9 is a top plan view in partial section, taken along the line 9—9 in FIG. 10 of a sixth embodiment of a pump in accordance with the invention.
Figure 10:
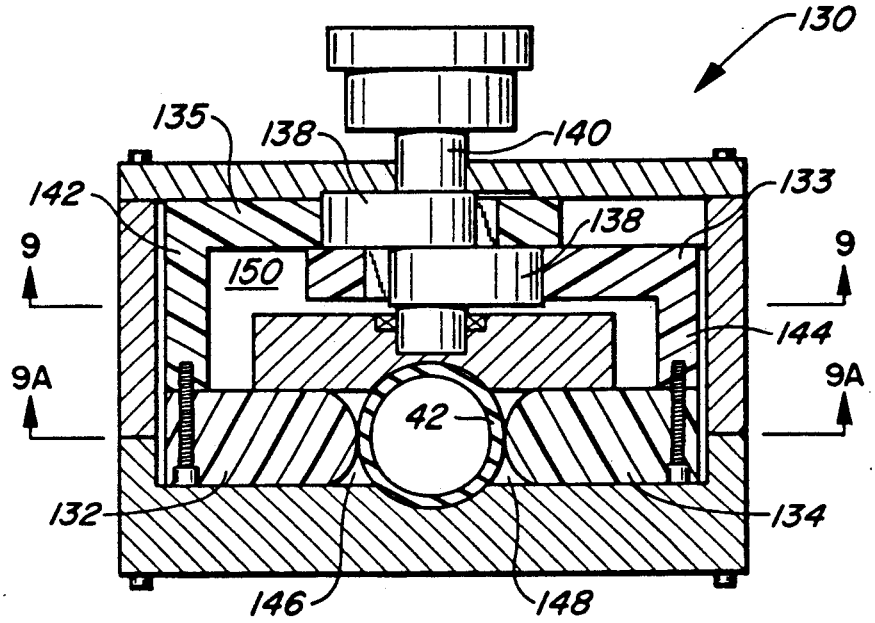
FIG. 10 is a section view, taken along the line 10—10 in FIG. 9.

FIGS. 9, 9A and 10 show a sixth pump 130, in which pressure blocks 132 and 134 depress tubing 42 on opposite sides. This construction allows roughly equivalent pumping to that obtained by flexing one side of the tubing 42 to half its inside diameter to be obtained by flexing each side of the tubing 42 to one quarter of its inside diameter. This lesser flexing on either side of the tubing 42 results in an even longer lifetime for the tubing. In the pump 130, rectangular cam follower blocks 133 and 135 are moved in opposite directions within housing 136 by eccentrically mounted cams 138 on common shaft 140. The cam follower blocks 133 and 135 each have a mounting portion 142 and 144 perpendicular to the blocks 133 and 135 and extending forward of the blocks 133 and 135 in the housing 136. The pressure blocks 132 and 134 are attached to the mounting portions 142 and 144, extending toward one another in slots 146 and 148 of plenum 150 of the housing 136, on either side of the tubing 42, which is positioned in supporting passage 152 extending through the housing 136. When the cams 138 are rotated, the pressure blocks 132 and 134 are moved simultaneously toward the tubing 42 for the pumping stroke and away from the tubing 42 for the filling stroke. Other than as shown and described, the construction and operation of the FIGS. 9–10 embodiment of the invention is the same as that of the FIGS. 1–3 embodiment.

Figure 11:
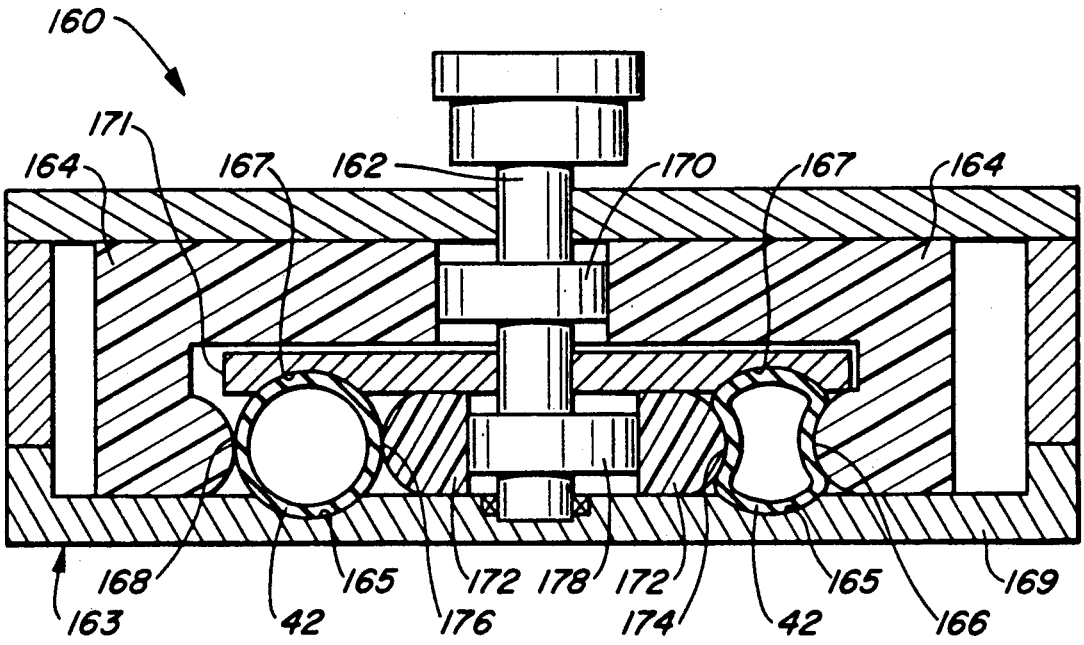
FIG. 11 is a section view, similar to that of FIG. 10, but of a seventh embodiment of a pump in accordance with the invention.
Figure 12A:
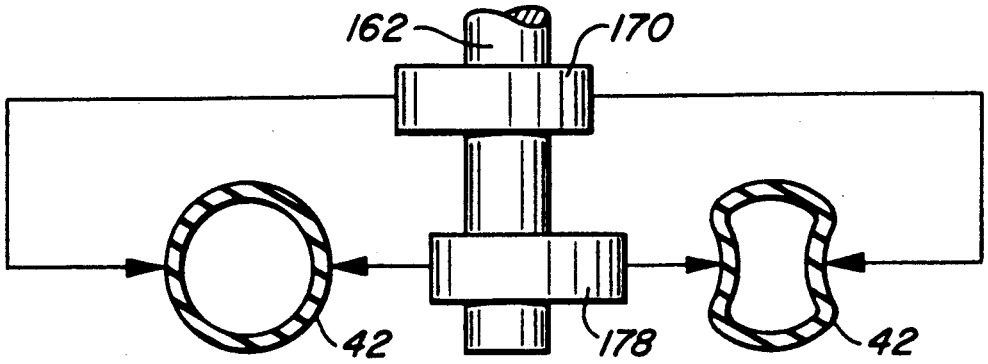
FIGS. 12A and 12B are schematic diagrams incorporating portions of the pump of FIG. 11, useful for understanding its operation.
Figure 12B:
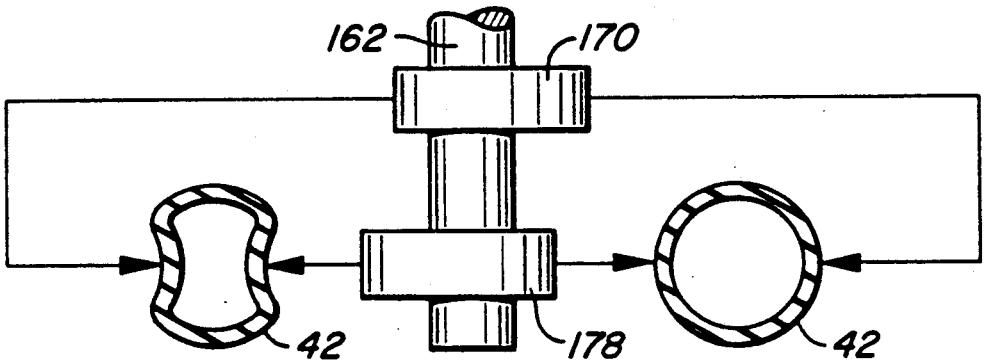

FIGS. 11 and 12A–12B show a seventh pump 160, in which the arrangement of the pump 130 of FIGS. 9–10 is extended to allow a pair of tubes 42 to be compressed using a single drive shaft 162. The tubes 42 are supported in housing 163 by curved surfaces 165 and 167, respectively on bottom plate 169 of the housing 163 and support plate 171 inside the housing 163. A single, outer pressure block 164 having right and left engaging surfaces 166 and 168 is reciprocated by an eccentrically mounted cam 170. In this manner, the pressure block 164 alternatively compresses the right and left tubes 42 from their outside positions, as can be seen in FIGS. 12A and 12B. An inside pressure block 172 having right and left engaging surfaces 174 and 176 is similarly reciprocated by eccentrically mounted cam 178 so that the surfaces 174 and 176 alternatively compress the right and left tubes 42, also indicated in FIGS. 12A and 12B. The relative positioning of the cams 170 and 178 on the shaft 162 and their respective relationships to the pressure blocks 164 and 172 is such that the tubes 42 are compressed from both their outside and their inside positions at the same time. Other than as shown and described, the construction and operation of the FIGS. 11–12B embodiment of the invention is the same as that of the FIGS. 9–10 and FIGS. 1–3 embodiments.

Figure 13C:
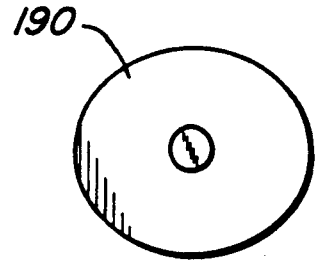
FIG. 13C is a plan view of a portion of the pump shown in FIGS. 13A and 13B.
Figure 13A:
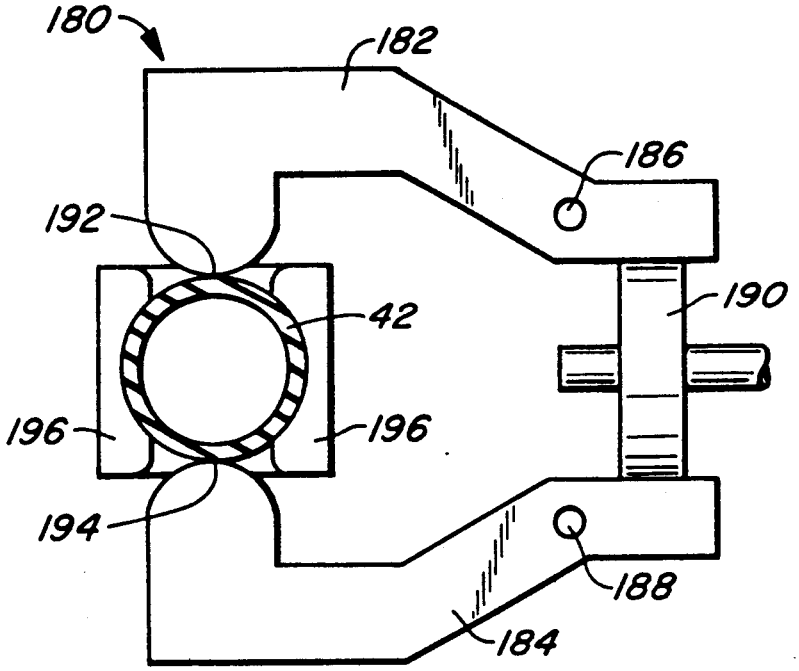
FIGS. 13A and 13B are end views of an eighth embodiment of a pump in accordance with the invention, showing the pump in different operating positions.
Figure 13B:
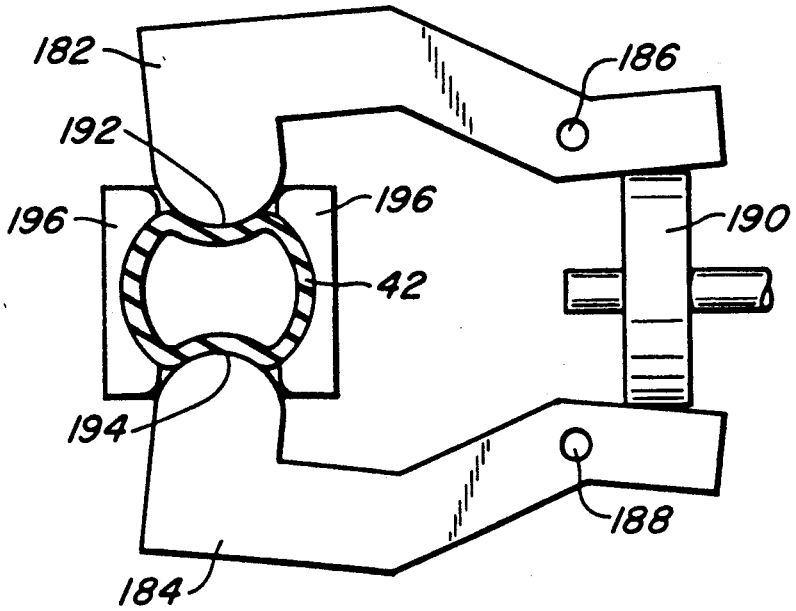

In the FIGS. 13A–13C embodiment, pump 180 has pressure blocks 182 and 184, mounted on pivots 186 and 188. Cam 190 simultaneously urges surfaces 192 and 194 of the pressure blocks 182 and 184 against tubing 42 by moving the pressure blocks 182 and 184 on their pivots 186 and 188 Support block 196 supports the tubing 42 where it is not deflected by the surfaces 192 and 194. Other than as shown and described, the construction and operation of the FIGS. 13A–13C embodiment is the same as that of the FIGS. 1–3 embodiment.

Figure 14:
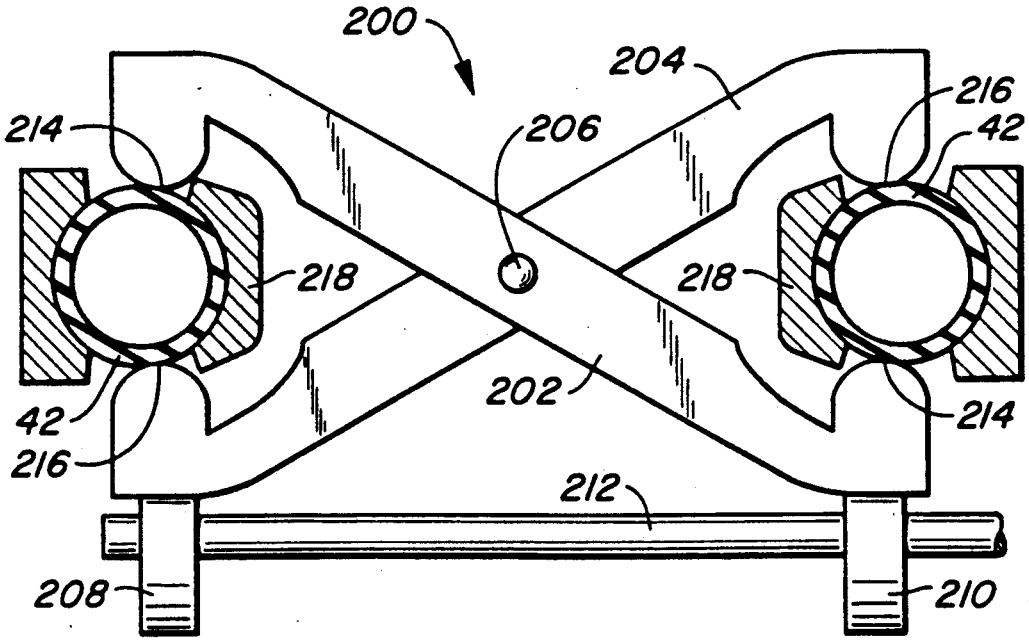
FIG. 14 is an end view similar to those of FIGS. 13A and 13B, but of a ninth embodiment of a pump in accordance with the invention.

FIG. 14 shows a pump 200 in which the approach of the pump 180 is extended to produce simultaneous compression of two tubes 42 on opposite surfaces. Pressure blocks 202 and 204 are mounted scissors fashion on a common pivot 206. A pair of eccentrically mounted cams 208 and 210 simultaneously push upwards on the pressure blocks 202 and 204 as shaft 212 rotates. As the pressure blocks pivot at 206, the tubes 42 are compressed on their tops and bottoms by surfaces 214 and 216. Support blocks 218 support the tubes 42 where they are not deflected by the surfaces 214 and 216. Other than as shown and described, the construction and operation of the FIG. 14 embodiment of the invention is the same as that of the FIGS. 13A–13C and FIGS. 1–3 embodiments.

It should now be readily apparent to those skilled in the art that a novel low fluid shear pump capable of achieving the stated objects of the invention has been provided. The pump is highly reliable in operation and will pump liquids without subjecting them to substantial mechanical shear stresses. It operates by deflecting a tube without creasing the tube or subjecting it to other localized severe distortion that will cause it to leak within a short time. As a result, the pump is able to pump biochemical liquids without damaging them and without leakage.

It should further be apparent to those skilled in the art that various changes in form and details of the invention as shown and described may be made. It is intended that such changes be included within the spirit and scope of the claims appended hereto.

What is claimed is:

1. A pump for fluid flow of liquids or suspensions without subjecting the liquids or suspensions to substantial mechanical stresses, which comprises a housing, a passage extending through said housing and closely conforming in configuration to an external configuration of a flexible tube in friction fit in said passage, an opening in said housing along a side of said passage along a substantial length of said flexible tube in said passage, a pressure block reciprocally moveable through said opening toward and away from said flexible tube alternately to depress and relax said flexible tube in said passage, said pressure block having a surface facing said flexible tube which extends along a substantial length of said flexible tube, a means for reciprocally moving said pressure block into and out of engagement with said flexible tube to depress said flexible tube in said passage, inlet and outlet check valves connected to said flexible tube below and above the surface of said pressure block, a second pressure block positioned on an opposite side of said flexible tube from said pressure block, a second opening in said housing along an opposite side of said passage from said opening along a substantial length of said flexible tube in said passage, said second pressure block being reciprocally moveable through said second opening into and out of engagement with said flexible tube to depress said flexible tube in said passage, said second pressure block having a second surface facing said flexible tube which extends along a substantial length of said flexible tube, and a means for reciprocally moving said second pressure block into and out of engagement with said flexible tube to depress said flexible tube in said passage.

2. The pump of claim 1 in which said means for reciprocally moving said pressure block into and out of engagement with said flexible tube and said means for reciprocally moving said second pressure block into and out of engagement with said flexible tube comprise a pair of eccentrically mounted cams on a common rotatable shaft and first and second apertures respectively in said pressure block and said second pressure block, each positioned to receive force from one of said pair of eccentrically mounted cams.

3. The pump of claim 1 in which said pump additionally comprises a second passage extending through said housing and closely conforming in configuration to an external configuration of a second flexible tube in said second passage, said housing having third and fourth openings in said second passage along a substantial length of said second passage, said pressure block being reciprocally movable through said third opening and having a third surface facing said second flexible tube which extends along a substantial length of said second flexible tube, said pressure block and said means for reciprocally moving said pressure block being positioned and configured so that said surface and said third surface alternately engage said flexible tube and said second flexible tube to depress said flexible tube in said passage and said second flexible tube in said second passage, said second pressure block being reciprocally movable through said fourth opening and having a fourth surface facing said second flexible tube, said second pressure block and said means for reciprocally moving said second pressure block being positioned and configured so that said second surface and said fourth surface alternately engage said flexible tube and said second flexible tube to depress said flexible tube in said passage and said second flexible tube in said second passage, said pressure block, said second pressure block, said means for reciprocally moving said pressure block and said means for reciprocally moving said second pressure block being configured and positioned so that said first and third surfaces and said second and fourth surfaces respectively depress said flexible tube and said second flexible tube simultaneously.

4. The pump of claim 3 in which said first and second pressure blocks are mounted on at least one pivot and reciprocate by pivoting about said at least one pivot.

5. The pump of claim 1 in which said first and second pressure blocks are mounted on at least one pivot and reciprocate by pivoting about said at least one pivot.

* * * * *